US008194108B1

(12) United States Patent
Long et al.

(10) Patent No.: US 8,194,108 B1
(45) Date of Patent: Jun. 5, 2012

(54) THERMAL PRINTER

(75) Inventors: David A. Long, Bellevue, WA (US); Christopher T. Northern, Redmond, WA (US)

(73) Assignee: Stafford Press, Inc., Redmond, WA (US)

( * ) Notice: Subject to any disclaimer, the term of this patent is extended or adjusted under 35 U.S.C. 154(b) by 305 days.

(21) Appl. No.: 12/660,173

(22) Filed: Feb. 22, 2010

(51) Int. Cl.
*B41J 2/335* (2006.01)
*B41J 2/32* (2006.01)

(52) U.S. Cl. ..... 347/206; 347/197

(58) Field of Classification Search ..... 347/206, 347/202, 204, 208, 209, 197
See application file for complete search history.

(56) References Cited

U.S. PATENT DOCUMENTS 6,061,076 A * 5/2000 Ishii et al. ..... 347/197
6,362,846 B1 * 3/2002 Nakamura ..... 347/206
7,611,299 B2 * 11/2009 Ochiai et al. ..... 347/198

OTHER PUBLICATIONS

Western Tag & Label, Catalog for 2009, entire catalog, 23 pages.
Western Tag & Label, Catalog for 2010, entire catalog, 23 pages.
Datamax Corporation, Datamax H Class Operator's Manual, 2006, entire operator's manual, 152 pages.
Datamax Corporation, Datamax H Class Operator's Manual, 2007, entire operator's manual, 176 pages.

* cited by examiner

*Primary Examiner* — Kristal Feggins
(74) *Attorney, Agent, or Firm* — Gregory W. Moravan

(57) ABSTRACT

A thermal printer that can print on media that is thicker than would otherwise be the case, because the outer surface of the heating element in its print head is oriented at an angle α with respect to a radial line A that extends from the center of its platen through the center of its heating element, wherein angle α is not essentially 90°; and/or because the output side of its ribbon and media is urged against the platen to curve arcuately around the platen for an angle γ, wherein angle γ is measured between radial line A and a line that extends from the center of the platen through the last contact point of the output side of the media with the outer surface of the platen.

20 Claims, 6 Drawing Sheets

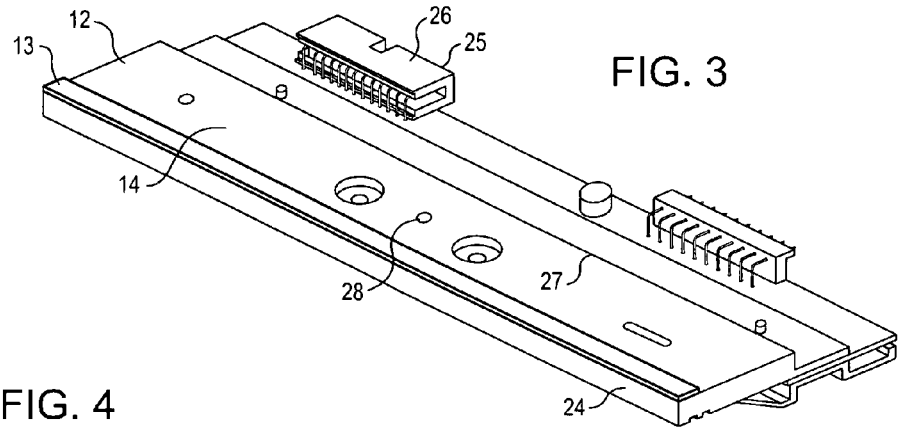
FIG. 3
FIG. 4
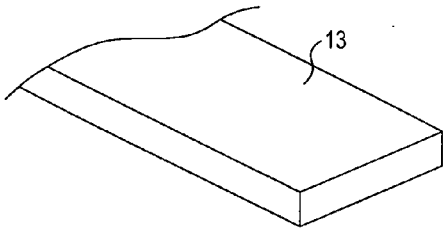
FIG. 5
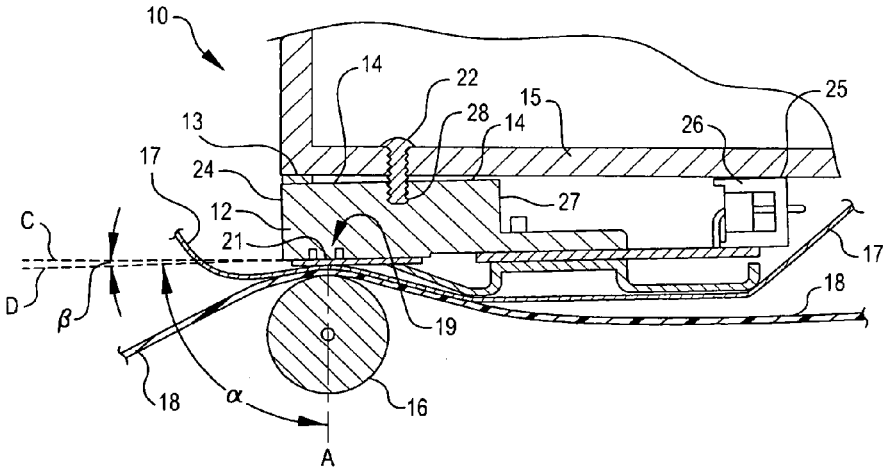

FIG. 6
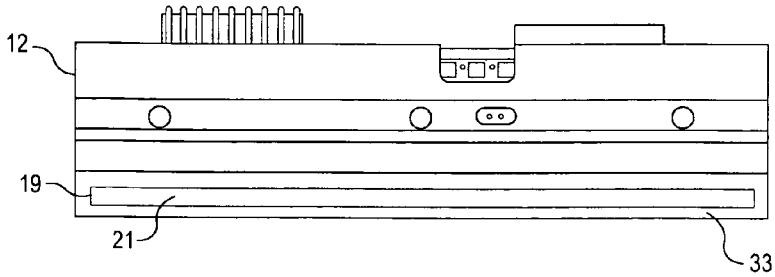
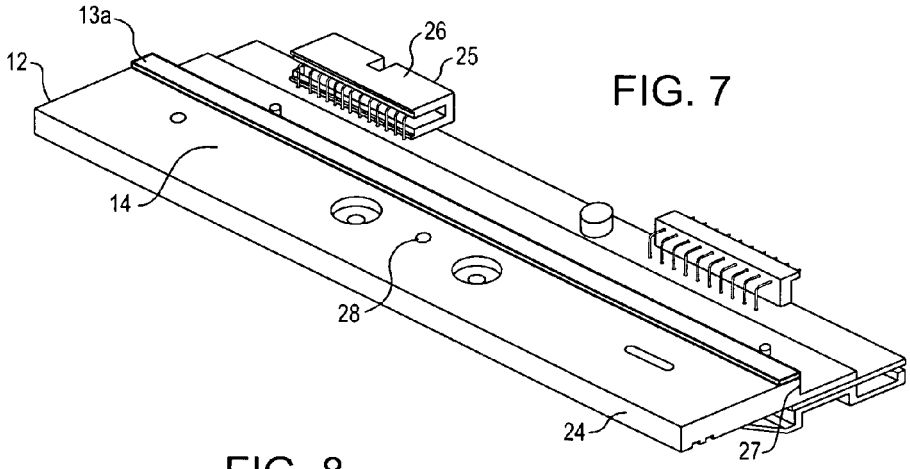
FIG. 7
FIG. 8
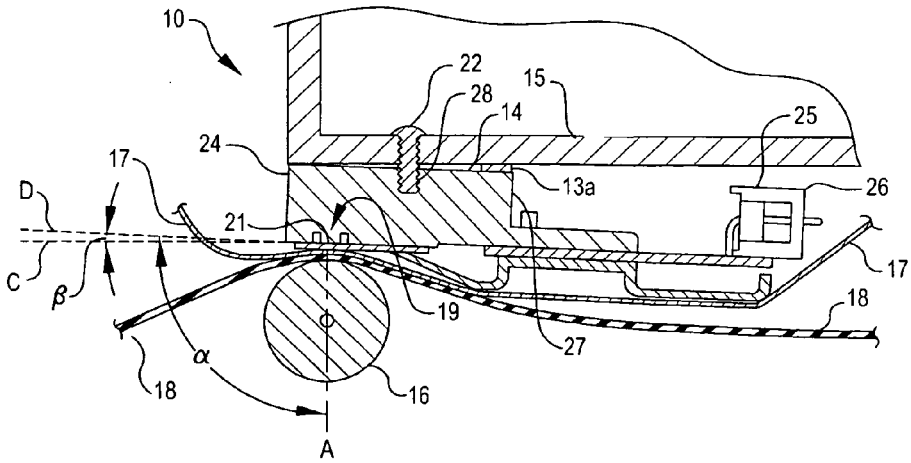

THERMAL PRINTER

STATEMENT REGARDING FEDERALLY SPONSORED RESEARCH OR DEVELOPMENT

The invention was not made by an agency of the United States Government or under a contract with an agency of the United States Government.

BRIEF DESCRIPTION OF THE SEVERAL VIEWS OF THE DRAWING

FIG. 3 is an upper perspective view of a print head 12 that has a front spacer 13 installed on the front portion of its top side 14;

FIG. 4 is an enlarged perspective view of the right end portion of the front spacer 13 of FIG. 3;

FIG. 5 is a cross-sectional view, taken along line 5-5 of FIG. 2, showing the print head 12 and front spacer 13 of FIG. 3 installed in a modified conventional thermal printer 10;

FIG. 6 is a bottom plan view of the print head 12;

FIG. 7 is an upper perspective view of a print head 12 that has a rear spacer 13*a* installed on the rear portion of its top side 14;

FIG. 8 is a cross-sectional view, taken along line 8-8 of FIG. 2, showing the print head 12 and rear spacer 13*a* of FIG. 7 installed in a modified conventional thermal printer 10;

DETAILED DESCRIPTION OF THE INVENTION

By way of non-limiting example, the modified conventional thermal printer 10 that is described and illustrated herein may comprise a modified Datamax® H Class thermal and RFID (Radio Frequency Identification) printer 10 made by the Datamax-O'Neil Corporation, 4501 Parkway Commerce Blvd., Orlando, Fla. 32808.

Hereby incorporated by reference are: (a) the 2006 Operator's Manual for the Datamax® H Class thermal and RFID (Radio Frequency Identification) printer, part number 88-2329-01, Revision B, 152 pages, and (b) the 2007 Operator's Manual for the Datamax H Class thermal and RFID (Radio Frequency Identification) printer, part number 88-2329-01, Revision E, 176 pages.

All parts of the modified conventional thermal printer 10 that are described and illustrated herein are conventional, aside from those expressly or inherently described or illustrated as being new or modified. Accordingly, for clarity, the various conventional parts of the modified conventional thermal printer 10 have been illustrated in a diagrammatic fashion, or have been omitted entirely, since the details of their conventional construction and operation need not be described herein in order for a person of ordinary skill in the art to have a full understanding of how to make and use the modified conventional thermal printer 10.

Figure 1:
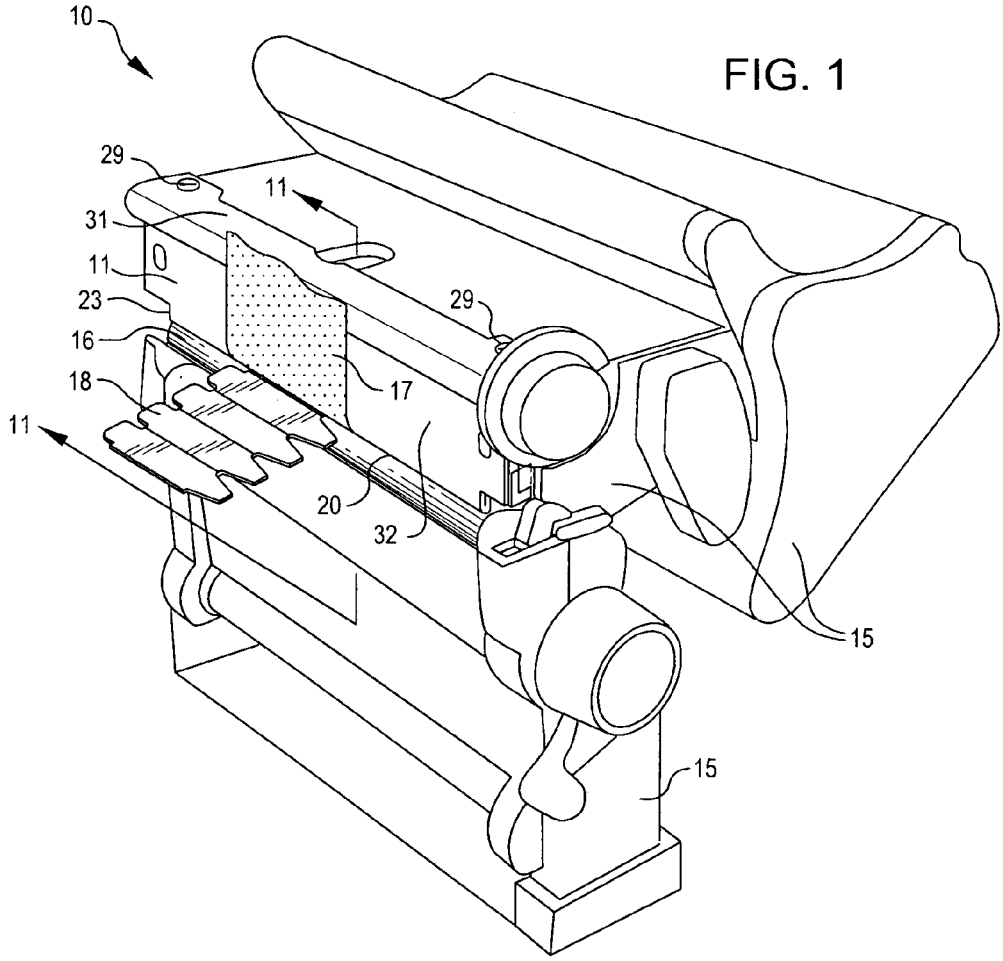
FIG. 1 is an upper perspective view of a conventional thermal printer 10 with a conventional front plate 11 installed.
Figure 2:
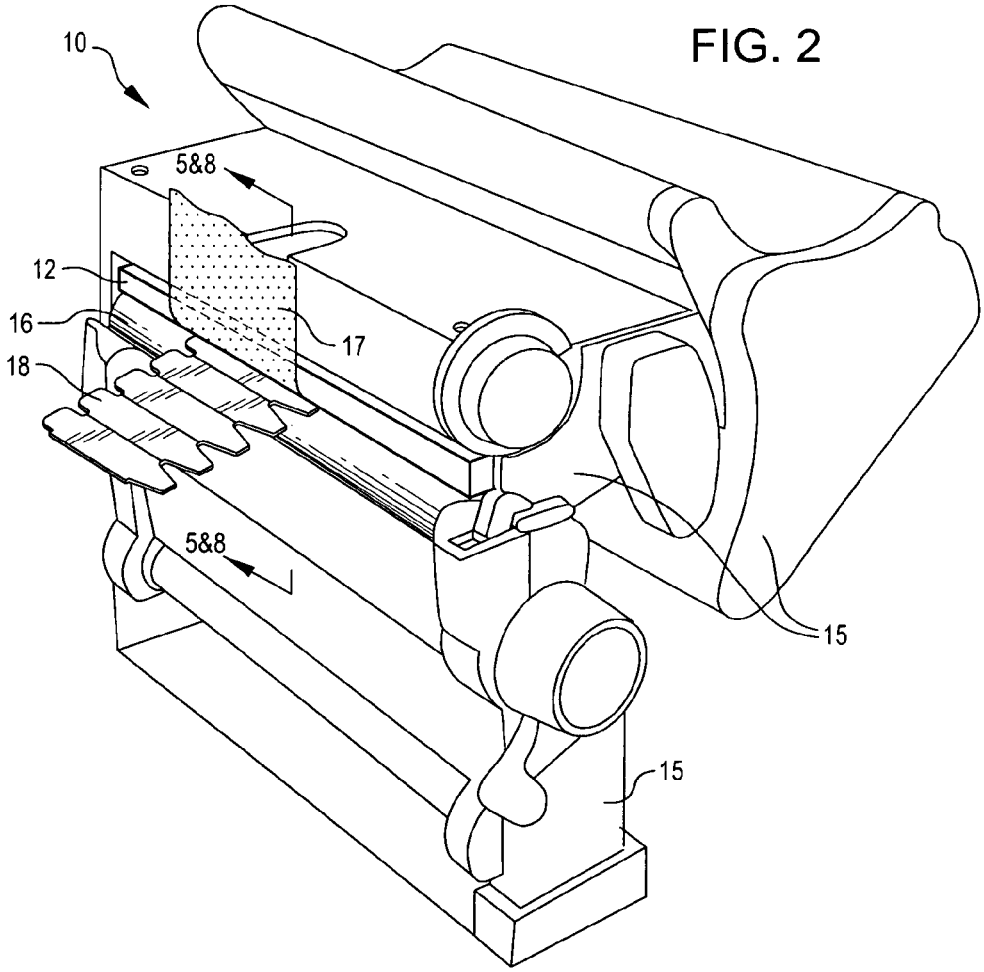
FIG. 2 is a view like that of FIG. 1, but with the conventional front plate 11 removed.

As seen in FIGS. 1 and 2, conventional thermal printer 10 may comprise a support assembly 15 for its front plate 11, print head 12, and platen 16. As best seen in FIGS. 1, 2, 5, 8 and 11, during operation of the conventional thermal printer 10 (FIGS. 1 and 2), and during operation of the modified conventional thermal printer 10 (FIGS. 5, 8 and 11), an inked ribbon 17 and the media 18 which is to be printed upon are fed and compressed between the platen 16 and the heating element 19 of the print head 12. As the ribbon 17 and media 18 pass between the platen 16 and print head 12, the heating element 19 heats the ribbon 17 to cause ink on the ribbon 17 to be transferred to the media 18.

As the used ribbon 17 exits from between the platen 16 and print head 12, it may pass against the rounded bottom edge 20 of the flange 23 on the bottom of the front plate 11 before it travels upwardly to be disposed of, such as by being wound on a take-up reel (not illustrated).

A conventional Datamax® H Class thermal printer 10 may print well on media 18 having a thickness of up to about 10 mils, i.e., media having a thickness of up to about 0.010 inches. However, it may not print well, or may not print at all, on media having a thickness that is greater than about 10 mils.

Figure 11:
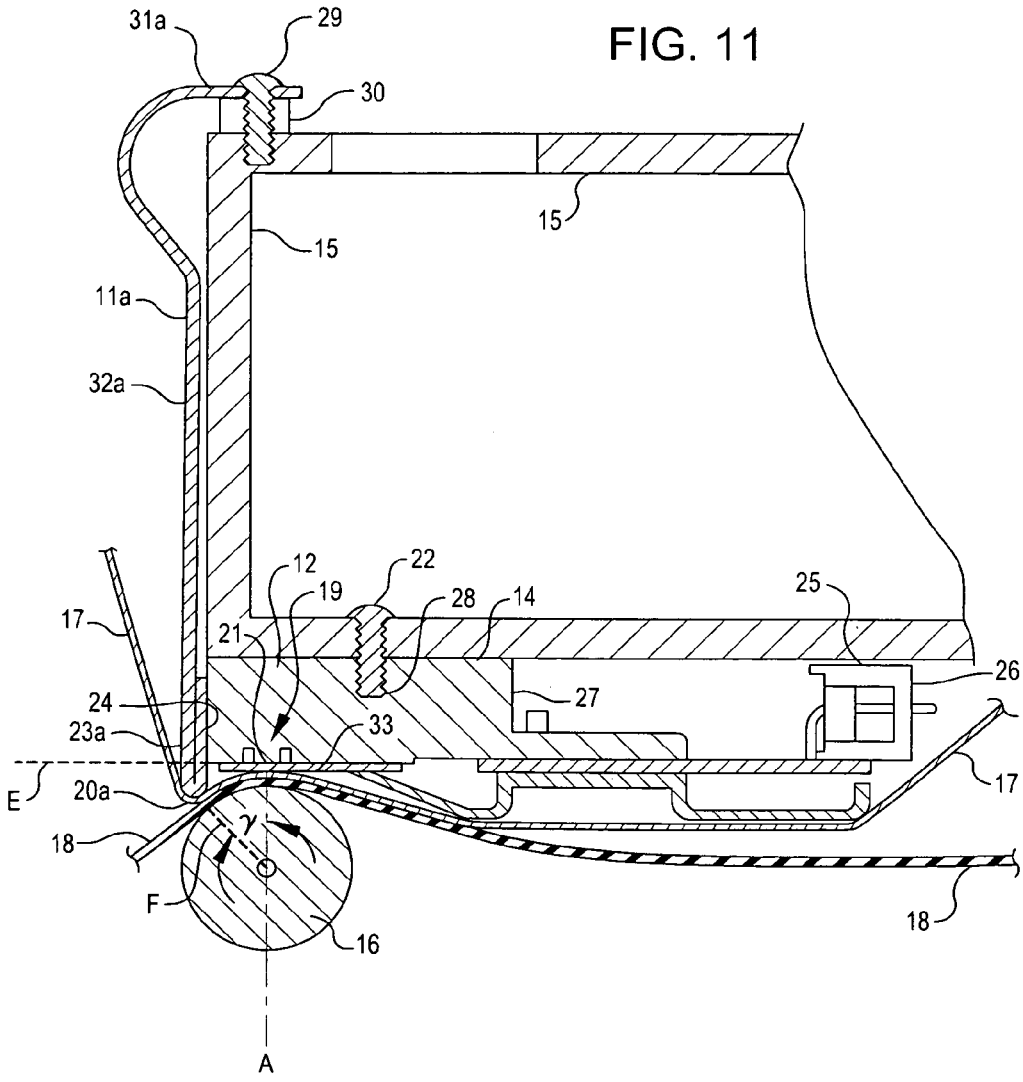
FIG. 11 is a cross-sectional view, taken generally along line 11-11 of FIG. 1, showing the modified front plate 11*a* and a print head 12 without any spacers 13*b*-13*g* installed in the modified conventional thermal printer 10.

As best seen in FIG. 11, during operation of a conventional Datamax® H Class thermal printer 10, plane D (defined by the outer surface 21 of the heating element 19 in the print head 12) is oriented at essentially a right angle with respect to a radial line A that extends between the center of the platen 16 and the longitudinal centerline of the outer surface 21 of the heating element 19.

Referring now to FIGS. 3-5, and 7-8 it has been discovered that if a conventional Datamax® H Class thermal printer 10 is suitably modified, then it may be able to print well on media having a thickness greater than about 10 mils, up to a thickness of about 30 mils.

For example, a conventional thermal printer 10 may be modified so that during its operation the outer surface 21 of the heating element 19 and plane D are not oriented at essentially a right angle with respect to radial line A of FIGS. 5 and 8 that extends between the center of the platen 16 and the longitudinal centerline of the outer surface 21 of the heating element 19.

Instead, the modified conventional thermal printer 10 may comprise a tipping means for tipping the outer surface 21 of the heating element 19 and plane D with respect to radial line A during operation of the modified conventional thermal printer 10, to enable the outer surface 21 and plane D to be oriented at an angle $\alpha$ with respect to radial line A, wherein angle $\alpha$ is not essentially equal to 90°; but is instead equal to 90°±angle $\beta$, wherein angle $\beta$ is not essentially zero degrees, but instead may fall in the range of from greater than essentially zero degrees to about 20°, and wherein a preferred angle $\beta$ may be about 6°.

Accordingly, angle $\alpha$ may fall in the range of from about 70° to about 110°, but is not equal to essentially 90°; and a preferred angle $\alpha$ may be about 84° or about 96°.

In FIGS. 5 and 8, plane C is oriented at a 90° angle with respect to radial line A, and plane D is defined by the outer surface 21 of the heating element 19 in the print head 12. A first side of angle $\alpha$ is defined by radial line A, while a second side of angle $\alpha$ is defined by the outer surface 21 and plane D. A first side of angle $\beta$ is defined by plane C, while a second side of angle $\beta$ is defined by the outer surface 21 and plane D. In FIG. 5, angle $\alpha$ plus angle $\beta$ will essentially be equal to 90°; while in FIG. 8 angle $\alpha$ minus angle $\beta$ will essentially be equal to 90°.

In general, it has been discovered that, within limits, the thickness of the media upon which the modified conventional thermal printer 10 will be able to successfully print that is greater than about 10 mils in thickness is proportional to angle β. In other words, within limits, as angle β increases, the thickness of the media 18 upon which the modified conventional thermal printer 10 will be able to successfully print will also increase, and vice versa; wherein the media has a thickness in the range of from greater than about 10 mils up to about 30 mils.

The tipping means for tipping the outer surface 21 of the heating element 19 and plane D with respect to radial line A during operation of the modified conventional thermal printer 10 may comprise any suitable apparatus, such as any suitable mechanical, electrical, hydraulic, or pneumatic apparatus.

Figure 9:
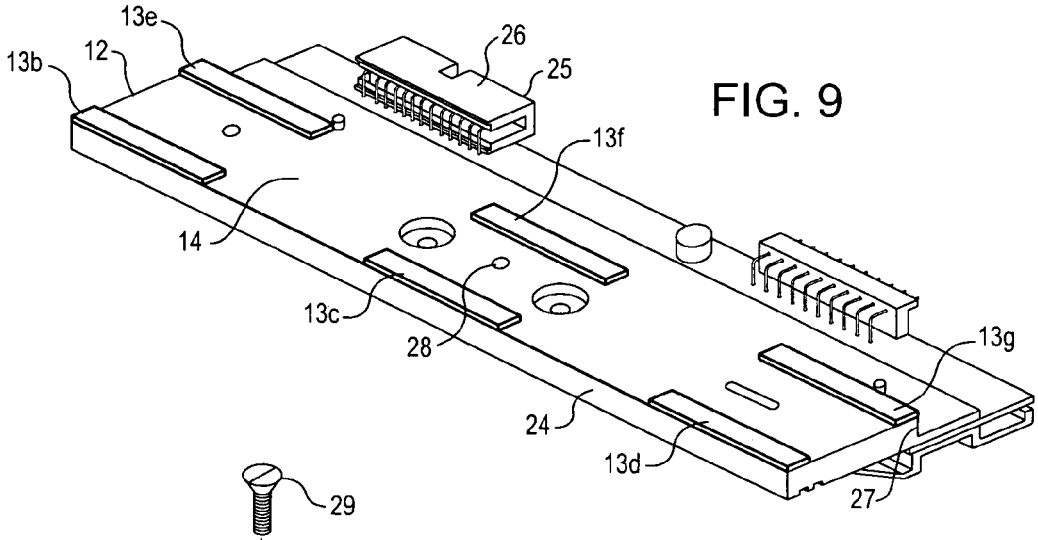
FIG. 9 is an upper perspective view of a print head 12 having alternative embodiments of front spacers 13*b*-13*d* and rear spacers 13*e*-13*g* installed in various locations on its top side 14.

For example, as seen in FIGS. 3, 5, and 7-9, the tipping means may comprise a front spacer 13 (FIGS. 3 and 5), a rear spacer 13*a* (FIGS. 7 and 8), front spacers 13*b*-13*d* (FIG. 9) or rear spacers 13*e*-13*g* (FIG. 9).

Regarding FIGS. 3 and 5, the front spacer 13 may be located on the top side 14 of the print head 12 at any suitable location selected such that when the print head 12 is mounted to the support assembly 15 by its mounting screw 22 in its mounting hole 28, the front spacer 13 causes the print head 12, the heating element 19, the top surface 21 of the heating element 19, and plane D to be tipped with respect to the support assembly 15 and with respect to radial line A during operation of the modified conventional thermal printer 10, to enable the top surface 21 and plane D to be oriented at the desired angle α with respect to radial line A. The front spacer 13 may, or may not, be secured to the top side 14.

Although the front spacer 13 is illustrated in FIGS. 3 and 5 as being located near the front edge 24 of the print head 12, it may be located in any other suitable position on the top side 14 of the print head 12, such as anywhere between the top side 14's front edge 24 and the mounting hole 28 for the print head mounting screw 22. It will be apparent from all of the disclosures herein that by suitably selecting the thickness and location of the front spacer 13, any particular desired angle α may be obtained. In general, for any particular desired angle α, the thickness of the front spacer 13 will decrease as its location approaches the mounting hole 28, as measured along a line that is normal to the front edge 24, and vice versa.

The front spacer 13 may have, for example, a width in the range of from about 0.25 cm to about 1.5 cm, with a preferred width that may be about 1.0 cm; it may have a thickness in the range of from about 0.5 mm to about 2 mm, with a preferred thickness that may be about 1.0 mm; and it may have a longitudinal length about equal to the longitudinal length of the print head 12, although it may be shorter than the longitudinal length of the print head 12. The front spacer 13 may be located with respect to the print head 12 so that the print head 12 essentially does not tip longitudinally (i.e., does not tip end to end), when the print head 12 is installed in the modified conventional thermal printer 10.

If the front spacer 13 is located as seen in FIGS. 3 and 5, if it has a thickness of about 1.0 mm, and if the print head 12 has an overall width of about 4.8 cm from its front edge 24 to the rear edge 25 of its connector 26, then angle α will be about 84° and angle β will be about 6°.

Referring now to FIGS. 7 and 8, as a further example and as an alternative, a rear spacer 13*a* may be provided on the rear portion of the top side 14 of the print head 12, at any suitable location selected such that when the print head 12 is mounted to the support assembly 15 by its mounting screw 22 in its mounting hole 28, the rear spacer 13*a* causes the print head 12, the heating element 19, the outer surface 21 of the heating element 19, and plane D to be tipped with respect to the support assembly 15 and with respect to radial line A during operation of the modified conventional thermal printer 10, to enable the outer surface 21 of the heating element 19 and plane D to be oriented at the desired angle α with respect to radial line A. The rear spacer 13*a* may, or may not, be secured to the top side 14.

Although the rear spacer 13*a* is illustrated as being located near the rear edge 27 of the print head 12, it may be located in any other suitable position on the top side 14 of the print head 12, such as anywhere between the top side 14's rear edge 27 and the mounting hole 28 for the print head mounting screw 22. It will be apparent from all of the disclosures herein that by suitably selecting the thickness and location of the rear spacer 13*a*, any particular desired angle α may be obtained. In general, for any particular desired angle α, the thickness of the rear spacer 13*a* will decrease as its location approaches the mounting hole 28, as measured along a line that is normal to the rear edge 27, and vice versa.

The rear spacer 13*a* may have, for example, the same dimensions as the front spacer 13 of FIGS. 3 and 5; and may be located with respect to the print head 12 so that the print head 12 essentially does not tip longitudinally (i.e., does not tip end to end), when the print head 12 is installed in the modified conventional thermal printer 10.

If the rear spacer 13*a* is located as seen in FIGS. 7 and 8, if it has a thickness of about 1.0 mm, and if the front portion of the print head 12 has an overall width of about 2.3 cm from its front edge 24 to its rear edge 27, then angle α will be about 96° and angle β will be about 6°.

Turning now to FIG. 9, it illustrates by way of example alternative front spacers 13*b*-13*d* and rear spacers 13*e*-13*g*. Although both front spacers 13*b*-13*d* and rear spacers 13*e*-13*g* are illustrated in FIG. 9, normally only one or more of the front spacers 13*b*-13*d*, or only or one or more of the rear spacers 13*e*-13*g* would be used at any given time. The front spacers 13*b*-13*e* are used like the front spacer 13 of FIGS. 3 and 5, and the rear spacers 13*f*-13*g* are used like the rear spacer 13*a* of FIGS. 7 and 8.

Aside from their respective lengths, the front and rear spacers 13*b*-13*g* may have the same dimensions as the front and rear spacers 13, 13*a* that were described above. Although all of the front and rear spacers 13*b*-13*g* are illustrated as having the same physical dimensions, one or more of the front spacers 13*b*-13*d* may have physical dimensions that are different from each other, and one or more of the rear spacers 13*e*-13*g* may have dimensions that are different from each other. There may be one, two, three, or more than three of the front spacers 13*b*-13*d*; and there may be one, two, three, or more than three of the rear spacers 13*e*-13*g*. Regardless of how many front or rear spacers 13*b*-13*g* that may be used, they may preferably be located with respect to the print head 12 so that the print head 12 essentially does not tip longitudinally (i.e., does not tip end to end), when the print head 12 is installed in the modified conventional thermal printer 10.

Although the front spacers 13*b*-13*d* are illustrated in FIG. 9 as being located near the front edge 24 of the print head 12, one or more of the front spacers 13*b*-13*d* may be located in any other suitable positions on the top side 14 of the print head 12, such as anywhere between the top side 14's front edge 24 and the mounting hole 28 for the print head mounting screw 22. It will be apparent from all of the disclosures herein that by suitably selecting the thickness and location of the front spacers 13*b*-13*d*, any particular desired angle α may be obtained. In general, for any particular desired angle α, the thickness of the front spacers 13*b*-13*d* will decrease as their respective locations approach the mounting hole 28, as measured along a line that is normal to the front edge 24, and vice versa.

Similarly, although the rear spacers 13*e*-13*g* are illustrated in FIG. 9 as being located near the rear edge 27 of the print head 12, one or more of the rear spacers 13*e*-13*g* may be located in any other suitable positions on the top side 14 of the print head 12, such as anywhere between the top side 14's rear edge 27 and the mounting hole 28 for the print head mounting screw 22. It will be apparent from all of the disclosures herein that by suitably selecting the thickness and location of the rear spacers 13*e*-13*g*, any particular desired angle α may be obtained. In general, for any particular desired angle α, the thickness of the rear spacers 13*e*-13*g* will decrease as their respective locations approach the mounting hole 28, as measured along a line that is normal to the rear edge 27, and vice versa.

From all of the disclosures herein, it will be apparent that any other suitable tipping means may be used in lieu of the spacers 13-13*g*, so that the print head 12, the heating element 19 that it carries, the outer surface 21 of the heating element 19, and plane D are tipped with respect to the support assembly 15 and with respect to radial line A during operation of the modified conventional thermal printer 10, to enable the outer surface 21 of the heating element 19 and plane D to be oriented at the desired angle α with respect to radial line A.

Alternatively, the print head 12 may be mounted to its support assembly 15 in its conventional manner, in which case the tipping means may comprise a heating element 19 mounted tipped in the print head 12 with respect to the rest of the print head 12 and with respect to radial line A during operation of the modified conventional thermal printer 10, to enable the outer surface 21 of the heating element 19 and plane D to be oriented at the desired angle α with respect to radial line A.

Referring now to FIGS. 1, 2, and 11 the conventional front plate 11 on a conventional Datamax® H Class thermal printer 10 is secured to the top of the support assembly 15 with a pair of screws 29. The flange 23 of the conventional front plate 11 has a vertical height of about 4 mm. During use of the conventional thermal printer 10, the bottom edge 20 of the conventional front plate 11 is about 2 mm above plane E (see FIG. 11), as measured along a line that is normal to plane E. Accordingly, the bottom edge 20 of the conventional front plate 11 does not urge the ribbon 17 or media 18 down against the platen 16 during use of the conventional thermal printer 10. Plane E is coplanar with the bottom 33 of the print head 12.

Figure 10:
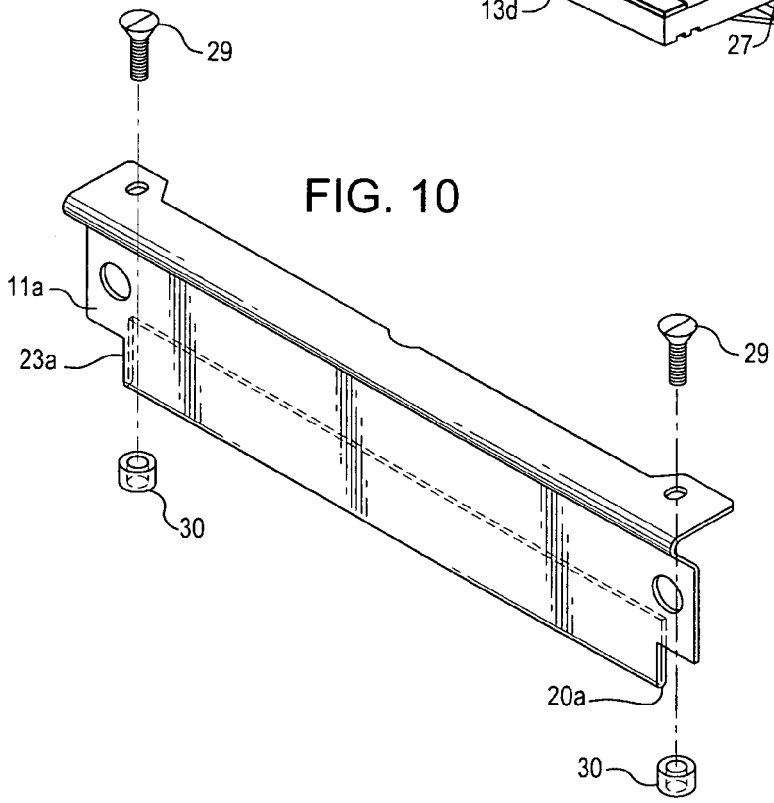
FIG. 10 is an upper perspective view of a modified front plate 11*a*.

Referring now to FIGS. 10 and 11, it has also been discovered that if a conventional Datamax® H Class thermal printer 10 is suitably modified in another way, then it may print well on media having a thickness greater than about 10 mils, up to a thickness of about 30 mils. The modifications described above regarding FIGS. 3-9 and the modifications that will be described below regarding FIGS. 10-11 may be used either separately, or in combination with each other. When they are used separately, the modified conventional thermal printer 10 may print well on media having a thickness greater than about 10 mils up to about 30 mils, but when they are used in combination with each other then the modified conventional thermal printer 10 may print even better on media having a thickness greater than about 10 mils up to about 30 mils.

For example, a modified conventional thermal printer 10 may be provided which may comprise an urging means for urging a portion of the output side of the media 18 towards the platen 16, and causing it to curve arcuately around the platen 16 for an angle γ. The urging means may also urge a portion of the output side of the ribbon 17 towards the platen 16, causing it to also curve arcuately around the platen 16 for an angle γ. The output side of the media 18 and ribbon 17 are the lateral sides thereof that exit the modified conventional thermal printer 10 from between the printing element 19 and platen 16.

Angle γ is the angle between radial line A that extends between the center of the platen 16 and the longitudinal centerline of the heating element 19, and radial line F that extends between the center of the platen 16 and the last contact point of the output side of the media 18 with the outer surface of the platen 16.

In general, angle γ will be about zero degrees when the urging means does not exert any force on the output side of the media 18 or ribbon 17. In general, angle γ may be functions of one or more factors, such as: (a) the amount of force that the urging means exerts on the output side of the media 18 or ribbon 17 (i.e., angle γ may grow larger as the amount of force increases, and vice versa); (b) the distance from the center of the platen 16 that the force is applied on the output side of the media 18 or ribbon 17 (i.e., angle γ may grow larger as the distance increases, and vice versa); and (c) the amount of travel of the force applied on the output side of the media 18 or ribbon 17 as measured along a line that is normal to plane E (i.e., angle γ may grow larger as the amount of travel increases, and vice versa).

In general, it has been discovered that, within limits, the thickness of the media upon which the modified conventional thermal printer 10 will be able to successfully print that is greater than about 10 mils in thickness is proportional to angle γ. In other words, within limits, as angle γ increases, the thickness of the media 18 upon which the modified conventional thermal printer 10 will be able to successfully print will also increase, and vice versa.

The urging means may comprise any suitable apparatus, such as any suitable mechanical, electrical, hydraulic, or pneumatic apparatus.

For example, as seen in FIGS. 10 and 11, the urging means may comprise a modified front plate 11*a*, which may be the same as the conventional front plate 11 that is illustrated in FIG. 1, except that its vertical height, as measured between its top 31*a* and its bottom edge 20*a* is greater than the corresponding vertical height of the conventional front plate 11 of FIG. 1. The greater vertical height of the modified front plate 11*a* may be achieved in any suitable way, such as by increasing the vertical height of its flange 23*a*, by increasing the vertical height of its front portion 32*a*, or by any combination thereof.

The urging means may also comprise a pair of optional spacers 30 and any suitable mounting means for mounting the modified front plate 11*a* and spacers 30 to the support assembly 15, such as the mounting screws 29, with the spacers 30 being located between the top 31*a* of the front plate 11*a* and the support assembly 15. The conventional front plate 11 of FIG. 1 does not utilize any spacers 30.

By way of example, it will be assumed that the greater vertical height of the modified front plate 11*a* is achieved by increasing the vertical height of its flange 23*a*; it being understood that similar comments may apply equally well if the greater vertical height is achieved in any other suitable way.

For example, the flange 23*a* may have a vertical height of 10 mm, which is greater than the 4 mm vertical height of the flange 23 of the conventional front plate 11. Thus, as seen in FIG. 11, during use of the modified conventional thermal printer 10, the rounded bottom edge 20*a* of the modified front plate 11*a* is lower than plane E, as measured along a line that is normal to plane E. Accordingly, the bottom edge 20*a* is operable to urge a portion of the output side of the media 18 downwardly towards the platen 16, causing it to curve arcuately around the platen 16 for angle γ. The bottom edge 20*a* may also be operable to urge a portion of the output side of the ribbon 17 downwardly towards the platen 16, causing it to also curve arcuately around the platen 16 for angle γ.

In general, angle γ will be about zero degrees when the bottom edge 20*a* of the modified front plate 11*a* is above, or is coplanar with, plane E; and may increase as a function of the distance between the bottom edge 20*a* and plane E, as measured along a line that is normal to plane E, and vice versa.

As has been mentioned, the front flange 23*a* may have, by way of example, a vertical height of 10 mm, which is 6 mm greater than the 4 mm vertical height of the front flange 23 of the conventional front plate 11. Accordingly, if the spacers 30 were 6 mm thick, then the bottom edge 20*a* of the modified front plate 11*a* would be located at the same vertical height (about 2 mm) above plane E, as measured along a line that is normal to plane E, as is the bottom edge 20 of the conventional front plate 11 that does not use any spacers 30.

On the other hand, if the spacers 30 were 4 mm thick, then the bottom edge 20*a* of the modified front plate 11*a* would be located coplanar with plane E.

And if the spacers 30 were selected to be less than about 4 mm thick, then the bottom edge 20*a* of the modified front plate 11*a* will be lowered vertically below plane E, as measured along a line that is normal to plane E, by a distance that is a function of the thickness of the spacers 30.

For example, if the spacers 30 were 2 mm thick, then the bottom edge 20*a* of the modified front plate 11*a* may be located below plane E a distance, as measured along a line that is normal to plane E, of about 2 mm, angle γ may be about 6°, and the modified conventional thermal printer 10 may be able to successfully print on media up to about 30 mils in thickness.

The bottom edge 20*a* of the modified front plate 11*a* may be located below plane E a distance, as measured along a line that is normal to plane, that ranges from greater than essentially zero mm, to about 4 mm (when there are no spacers 30 being used), which may correspond to angle γ falling in the range of from greater than essentially zero degrees to about 15°, and which may correspond to the modified conventional thermal printer 10 being able to successfully print on media 18 having a thickness in the range of about 10 mils to about 30 mils. The angle γ may preferably be about 6°.

In general, as the distance that the bottom edge 20*a* extends below plane E increases, as measured along a line that is normal to plane E, angle γ and the thickness of the media 18 upon which the thermal modified conventional thermal printer 10 will successfully print will also increase, and vice versa.

It will be apparent from all of the disclosures herein that by suitably selecting the vertical height of the modified front plate 11*a* and the thickness of the spacers 30, or any desired combination thereof, any particular desired angle γ, or desired range of angles γ, may be obtained. In general, as the vertical height of the modified front plate 11*a* is increased, or as the thickness of the spacers 30 is decreased, angle γ will increase, and vice versa.

Alternatively, the spacers 30 may be eliminated, in which case any particular desired angle γ may be obtained by providing a corresponding particular modified front plate 11*a* that had a vertical height that was selected to produce the particular desired angle γ.

From all of the disclosures herein, it will be apparent that there are many other ways of modifying a conventional Datamax® H Class thermal printer 10 so that during use the desired angle γ may be provided.

For example, the urging means may comprise any suitable mechanical, electrical, hydraulic, pneumatic, or other means that may be used in lieu of the spacers 30 and mounting screws 29, to mount the modified front plate 11*a* to its support assembly 15 in such as way that its bottom edge 20*a* may be moved up and down any desired distance with respect to plane E, as measured along a line that is normal to plane E, so that it is operable to push down on a portion of the output side of the media 18 or ribbon 17 from above an amount sufficient to create any desired angle γ, or any desired range of angles γ.

As further alternatives, the modified conventional thermal printer 10 may comprise a conventional front plate 11, and no spacers 30. In such an event, the urging means may comprise any suitable mechanical, electrical, hydraulic, pneumatic, or other means that may be used to push down from above on the upper surface of a portion of the output side of the media 18 or ribbon 17, or to pull down from below on the upper surface of a portion of the output side of the media 18 or ribbon 17, any desired distance with respect to plane E, as measured along a line that is normal to plane E, in order to create any desired angle γ, or any desired range of angles γ. In this context, the terms "above" and "below" are relative terms, and refer to the relative locations with respect to each other of the various components of the modified conventional thermal printer 10 that is shown in FIG. 11; it being understood that those relative locations would remain unchanged even if the modified conventional thermal printer 10 of FIG. 11 were rotated up to 360°.

It is to be understood that, without departing from the scope and spirit of the claimed invention, any particular part of the modified conventional thermal printer 10 may be suitably combined or formed with one or more of its other parts to form one integral or composite part; that any particular part of the modified conventional thermal printer 10 that may be made in one piece may instead be made by assembling together in any suitable way, two or more sub-pieces; and that the various parts of the modified conventional thermal printer 10 may be assembled together in any suitable ways other than those described herein, such by using fasteners; interference fits, friction fits; barbed, threaded, bonded, glued or welded connections; splines; keys; or mechanical couplers.

It is also to be understood that the specific embodiments of the claimed invention that are disclosed herein were disclosed strictly by way of non-limiting example. Accordingly, various modifications may be made to those embodiments without deviating from the scope and spirit of the claimed invention. Additionally, certain aspects of the claimed invention that were described in the context of a particular embodiment may be combined or eliminated in other embodiments. Although advantages associated with a certain embodiment of the claimed invention have been described in the context of that embodiment, other of the embodiments may also exhibit such advantages. Further, not all embodiments need necessarily exhibit any or all of such advantages in order to fall within the scope of the claimed invention.

Before an element in a claim is construed as claiming a means for performing a specified function under 35 USC section 112, last paragraph, the words "means for" must be used in conjunction with that element.

When the phrase "at least one of" is used in any of the claims, that phrase is defined to mean that any one, any more than one, or all, of the listed things or steps following that phrase is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, and/or all of A, B and C.

As used herein, except in the claims, the words "and" and "or" are each defined to also carry the meaning of "and/or".

In view of all of the disclosures herein, these and further modifications, adaptations and variations of the claimed invention will now be apparent to those of ordinary skill in the art to which it pertains, within the scope of the following claims.

What is claimed is:

1. A thermal printer for thermally transferring ink from an inked ribbon to a media;

wherein said printer comprises a platen and a print head; wherein said platen is cylindrical, has a center, and has an outer surface; wherein said print head comprises a heating element;

wherein said heating element has an outer surface that lies essentially in a plane D that is defined by said outer surface of said heating element; wherein said outer surface has a longitudinal centerline;

wherein a radial line A extends between said center of said platen and said longitudinal centerline of said outer surface of said heating element;

wherein during operation of said printer a first side of an angle $\alpha$ is defined by said radial line A, while a second side of said angle $\alpha$ is defined by said outer surface of said heating element and said plane D; and wherein said angle $\alpha$ is not essentially equal to 90°, to enable said printer to be operable to print on media that is thicker than would otherwise be the case.

2. The printer of claim 1, wherein said media has a thickness that falls in the range of from greater than 10 mils to about 30 mils.

3. The printer of claim 1, wherein said angle $\alpha$ falls in the range of from about 70° to about 110°, but is not essentially equal to 90°.

4. The printer of claim 1, wherein a plane C extends at a right angle with respect to said radial line A; wherein a first side of angle $\beta$ is defined by said plane C, while a second side of angle $\beta$ is defined by said outer surface of said heating element and said plane D; and wherein said angle $\beta$ is not essentially equal to zero degrees.

5. The printer of claim 4, wherein said angle $\beta$ falls in the range of about ±20°, but is not essentially equal to zero degrees.

6. The printer of claim 4, wherein said printer further comprises a tipping means for tipping said outer surface of said heating element and said plane D with respect to said radial line A during operation of said printer, to enable said outer surface of said heating element and said plane D to be oriented at said angle $\alpha$ with respect to said radial line A.

7. The printer of claim 6, wherein said printer further comprise a support assembly for said print head; and wherein said tipping means are for tipping said print head, said heating element, said outer surface of said heating element, and said plane D with respect to said support assembly and with respect to said radial line A during operation of said printer, to enable said outer surface of said heating element and said plane D to be oriented at said angle $\alpha$ with respect to said radial line A.

8. The printer of claim 7, wherein said tipping means further comprises a spacer located between said support assembly and said print head at a location selected to tip said print head, said heating element, said outer surface of said heating element, and said plane D with respect to said support assembly and with respect to said radial line A during operation of said printer, to enable said outer surface of said heating element and said plane D to be oriented at said angle $\alpha$ with respect to said radial line A.

9. The printer of claim 6, wherein said tipping means comprises said heating element being mounted tipped in said print head with respect to said radial line A during operation of said printer; to enable said outer surface of said heating element and said plane D to be oriented at said angle $\alpha$ with respect to said radial line A.

10. The printer of claim 1, wherein said media and said ribbon each comprise a respective output side; and wherein said printer further comprises urging means for urging a portion of said respective output side of at least one of said media and said ribbon towards said platen and for causing said portion of said respective output side of at least one of said media and said ribbon to curve arcuately around said platen for an angle $\gamma$ during operation of said printer; and wherein said angle $\gamma$ is defined between said radial line A and a radial line F that extends between said center of said platen and a last contact point of said portion of said output side of the media with said outer surface of said platen.

11. The printer of claim 10, wherein said angle $\gamma$ falls in the range of from greater than essentially zero degrees, to about 15°.

12. The printer of claim 10, wherein said media has a thickness that falls in the range of from greater than 10 mils to about 30 mils.

13. The printer of claim 10 wherein said media and said ribbon each have a respective upper surface; and wherein said urging means are operable to pull down from below on a portion of said respective upper surface of at least one of said media and said ribbon.

14. The printer of claim 10 wherein said media and said ribbon each have a respective upper surface; and wherein said urging means are operable to push down from above on a portion of said respective upper surface of at least one of said media and said ribbon.

15. The printer of claim 14, wherein said printer further comprise a support assembly for said print head; wherein said urging means comprises a front plate having a bottom edge; wherein said front plate is mounted to said support assembly; and wherein, during operation of said printer, said bottom edge of said front plate is operable to urge said portion of said respective output side of at least one of said media and said ribbon towards said platen, and is further operable to cause said portion of said output side of said media to curve arcuately around said platen for said angle $\gamma$.

16. The printer of claim 15, wherein said bottom edge of said front plate has a location with respect to said portion of said respective output side of at least one of said media and said ribbon; wherein said printer further comprises at least one spacer for said front plate; wherein said spacer is located between said front plate and said support assembly; wherein said at least one spacer has a thickness; and wherein said location of said bottom edge of said front plate is a function of said thickness of said at least one spacer.

17. The printer of claim 10 wherein said media and said ribbon each have a respective upper surface; and wherein said urging means are operable to push down from above on a portion of said respective upper surface of at least one of said media and said ribbon.

18. A thermal printer for thermally transferring ink from an inked ribbon to a media;

wherein said printer comprises a platen and a print head;

wherein said platen is cylindrical, has a center, and has an outer surface; wherein said print head comprises a heating element; wherein said heating element has an outer surface that has a longitudinal centerline;

wherein a radial line A extends between said center of said platen and said longitudinal centerline of said outer surface of said heating element;

wherein said media and said ribbon each comprise a respective output side; and wherein said printer further comprises urging means for urging a portion of said respective output side of at least one of said media and said ribbon towards said platen and for causing said portion of said respective output side of at least one of said media and said ribbon to curve arcuately around said platen for an angle γ during operation of said printer; and wherein said angle γ is defined between said radial line A and a radial line F that extends between said center of said platen and a last contact point of said portion of said output side of the media with said outer surface of said platen.

19. The printer of claim 18, wherein said angle γ falls in the range of from greater than essentially zero degrees, to about 15°.

20. The printer of claim 18 wherein said media and said ribbon each have a respective upper surface; and wherein said urging means are operable to pull down from below on a portion of said respective upper surface of at least one of said media and said ribbon.

* * * * *